United States Patent [19]

Hope et al.

[11] Patent Number: 4,906,899

[45] Date of Patent: Mar. 6, 1990

[54] FLUORESCENT LAMP REGULATING SYSTEM

[76] Inventors: Rodney C. Hope, Edmonton, Canada, by Gale M. Hope; executrix; Gale M. Hope, executrix, 4312 - 37 Street, Edmonton, Alberta, Canada, T6L 4J7

[21] Appl. No.: 919,492

[22] Filed: Oct. 16, 1986

[51] Int. Cl.[4] ..... H05B 41/14

[52] U.S. Cl. ..... 315/96; 315/122; 315/189; 315/201

[58] Field of Search ..... 315/96, 101, 106, 107, 315/122, 189, 201, 205

[56] References Cited

U.S. PATENT DOCUMENTS 4,101,806 7/1978 Alley ..... 315/86
4,227,118 10/1980 Britton ..... 315/101
4,256,993 3/1981 Morton ..... 315/106
4,410,836 10/1983 Roche ..... 315/96
4,661,745 4/1987 Citino et al. ..... 315/107

FOREIGN PATENT DOCUMENTS 2755614 12/1977 Fed. Rep. of Germany .

*Primary Examiner*—Benedict V. Safourek
*Assistant Examiner*—T. Salindong
*Attorney, Agent, or Firm*—Fleit, Jacobson, Cohn, Price, Holman & Stern

[57] ABSTRACT

One of the low voltage output windings of a standard ballast circuit is coupled to one filament of a pair of series connected fluorescent lamps by an external current controller. The current controller acts to restrictively reduce the operating voltage applied to the filaments of one of the lamps to which it is connected, below firing value during start up operation and thereafter maintain a lower running voltage for the lamps without adversely affecting restart.

11 Claims, 2 Drawing Sheets

FLUORESCENT LAMP REGULATING SYSTEM

BACKGROUND OF INVENTION

This invention relates to operation of electron discharge devices, such as fluorescent lamps, that require the use of a ballast circuit for plasma induced current starting purposes.

Generally, the ballast circuit with multiple fluorescent lamps includes a power supply transformer having a plurality of low voltage windings connected to the opposite filaments of the lamps, with a starting capacitor connected across one pair of filaments of one of the lamps. Various regulated devices for ballasted fluorescent lamps are known or have been proposed to assist starting, protect lamp filaments and other related purposes. For example, each of U.S. Pat. Nos. 4,101,806 and 4,410,836 to Alley and Roche, respectively, show two fluorescent lamps having filaments interconnected externally of the lamps and coupled to one of the secondary winding of a ballast transformer with the other filaments of the respective lamps being coupled to two other secondary windings of the transformer. The latter patents also show a starting capacitor connected across the filaments within one of the lamps as part of a ballast starting control system.

Other ballast regulating techniques are known, such as the use of diodes coupling the secondary winding of the ballast transformer to both filaments of a single lamp, such diodes interacting with each other for the purpose of switching the supply of current to only that one of the filaments having the higher potential in order to maintain a constant temperature despite wide current variations from the power source. Such diode arrangement is disclosed in German Pat. No. 2,755,614. U.S. Pat. No. 4,227,118 to Britton also shows a single lamp to which current is supplied through a ballast capacitor and an inductor acting as a voltage doubler and interacting with a Zener diode and thyrsistor coupled to the other filament of the lamp to achieve more rapid ignition of the lamp. Neither of the latter patents relates to ballast control peculiar to series connected lamps which interact in response to current control exercised with respect to one of the lamps.

It is therefore, an important object of the present invention to provide a control attachment to the ballast arrangement associated with two interconnected fluorescent lamps for modifying joint ignition of such lamps under existing ballast control to reduce energy consumption both during the start-up operation and the steady state running operation without adversely affecting restart.

It is an additional object of the present invention to provide a low cost current control device capable of being readily interfaced with existing ballast circuits for two or more fluorescent lamps to improve ballast efficiency, reduce current consumption and prolong lamp life expectancy.

SUMMARY OF THE INVENTION

In accordance with the present invention, the low voltage of a standard ballast circuit connected to one of the filaments of a pair of series connected lamps is modified in such a manner as to reduce the current drawn and decrease the operating temperature during start-up without adversely affecting restart. Toward that end, a current controller is inserted between said one of the lamp filaments and a low voltage output of the ballast circuit otherwise directly connected to such filament. The current controller includes a regulating capacitor that is cyclically charged by interaction with a phase control diode in one embodiment through which a DC plate supply voltage is applied to said one of the filaments in order to maintain a first lamp of said pair of lamps below firing state during start-up. Firing voltage is applied only across the filaments of the second lamp of the pair. After start-up, the resulting plasma current in the second lamp causes firing of the first lamp with which the current controller is associated.

According, to another embodiment of the invention, the action of the current controller during start-up operation is delayed by means of a timing circuit to initially utilize the full available source voltage and thereby insure ignition of the lamps under low voltage conditions.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF PREFERRED EMBODIMENTS

Figure 1:
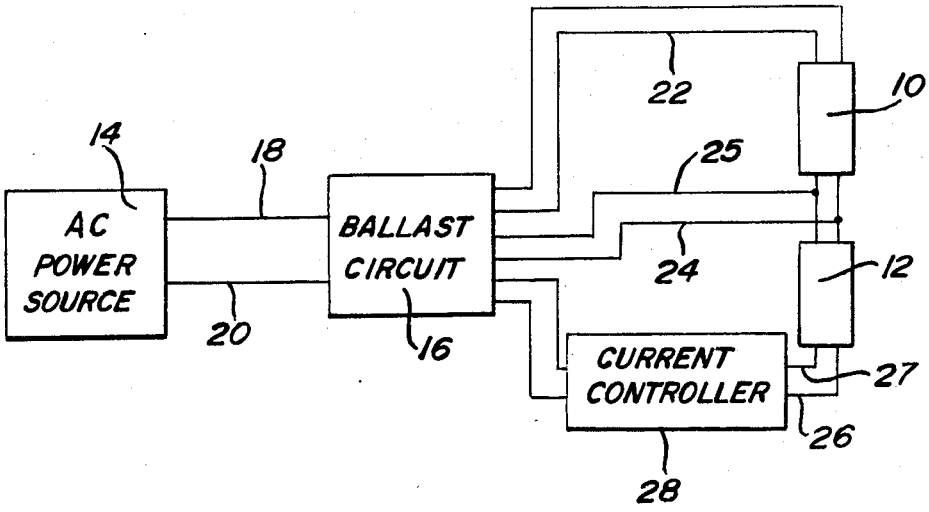
FIG. 1 is a block diagram illustrating the installation of the present invention.

Referring now to the drawings in detail, FIG. 1 diagramically illustrates a pair of series connected electron discharge devices 10 and 12, such as fluorescent lamps, connected to an AC voltage source 14 through a standard ballast circuit 16. The power lines 18 and 20 extend from the source 14 to the high voltage side of the ballast circuit which has a low voltage side from which outputs are applied across the electron discharge lamps 10 and 12 under starting and running conditions. In accordance with the present invention, a current controller 28 is placed in one of the three low voltage outputs of the standard ballast circuit for the series connected fluorescent lamps 10 and 12 in order to modify the characteristics of the output voltage and current otherwise operative to fire and run the lamps.

Figure 4:
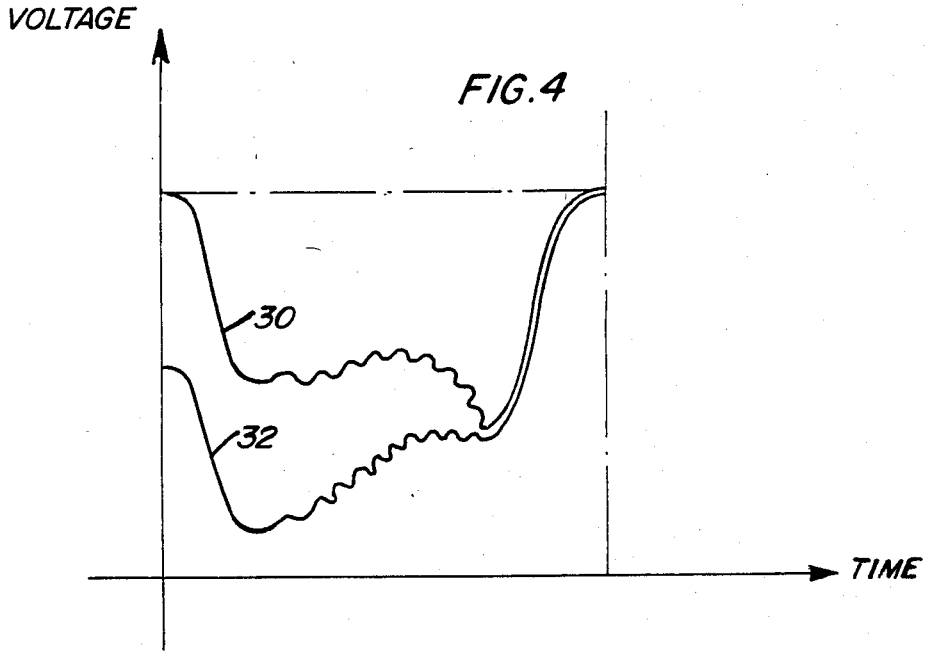
FIG. 4 is a graphical illustration of the voltage signal characteristic modified in accordance with the present invention.

FIG. 4 illustrates a standard wave form curve 30 characterizing a typical output signal of the ballast circuit having a sloping square wave shape. Curve 32 represents the output signal modified by the current controller 28, exhibiting a decrease in voltage amplitude without any change in phase. The effect of such output signal modification is to apply a potential difference across the filaments of lamp 12 less than the firing voltage applied to lamp 10 during start-up in order to ignite both lamps with a reduced current. Further, the overall operating temperature of the ballast 16 is typically reduced from 60° to approximately 45° to effectively prolong ballast circuit life. Also, firing of the lamps at a lower temperature increases their life expectancy.

Figure 2:
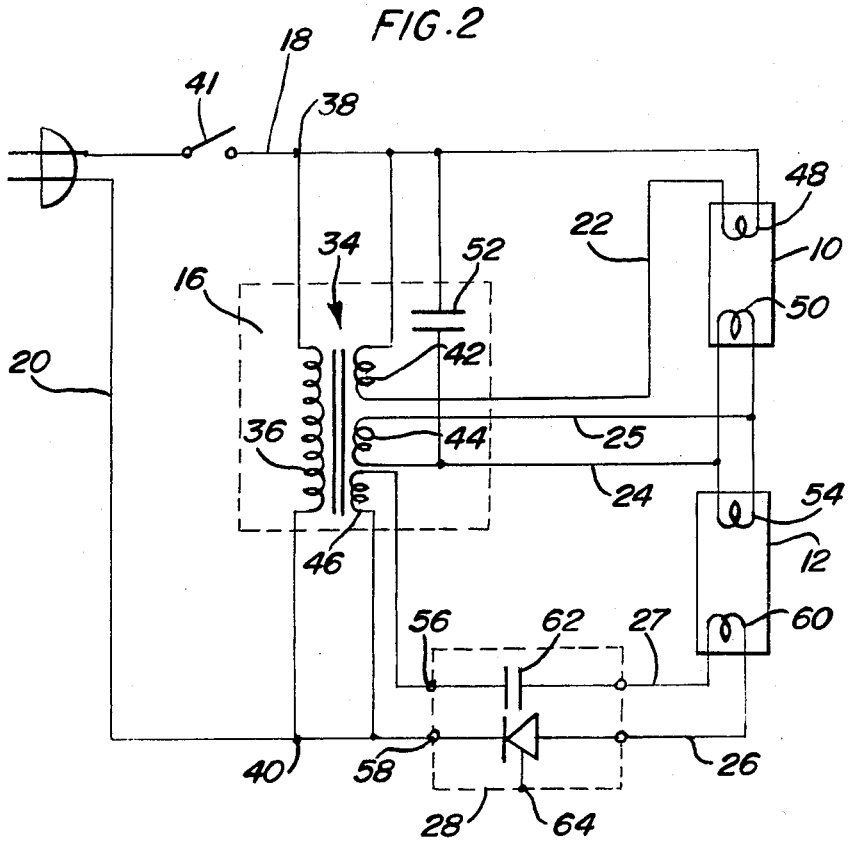
FIG. 2 is a circuit diagram illustrating in greater detail one embodiment of the invention.

FIG. 2 illustrates in greater detail a series reactor type of standard ballast circuit 16 including a transformer 34 having a primary winding 36 connected across the AC voltage source through lines 18 and 20 at its opposite terminals 38 and 40 upon closing of an on-off power switch 41. Three secondary output windings 42, 44 and 46 are associated with the transformer 34. Secondary winding 42 is connected at one end to the terminal 38 of the primary winding and at its other end to cathode filament 48 associated with lamp 10 through output line 22. The filament 48 is connected directly to line 18 to which the primary winding terminal 38 is also connected. The opposite cathode filament 50 of lamp 10 is connected across the secondary winding 44 by output voltage lines 24 and 25. A starting capacitor 52 connected across lines 18 and 24 shunts the windings 42 and 44 and the filaments 48 and 50 and complete the ballast circuit, as is well known in the art, for the purpose of assisting starting, reducing shock hazard, and minimizing transference of EMF to the ballast circuit.

The filament 50 of lamp 10 is interconnected in series with one filament 54 of lamp 12 and both filaments 50 and 54 are interconnected in parallel to the secondary output winding 44 in lines 24 and 25. The secondary output winding 46 is connected across the input terminals 56 and 58 of the current controller 28 separately from the starting capacitor 52 as shown in order to apply a low voltage output of the ballast 16 through the controller and lines 26 and 27 to the other cathode filament 60 of lamp 12 independently of the starting capacitor. Input terminal 58 is directly connected to terminal 40 of the primary winding to which input voltage line 20 is connected.

The current controller 28 as shown in FIG. 2 includes a regulating capacitor 62 connected to secondary winding 46 through terminal 56 for cyclic or periodic recharging. A current rectifying diode 64 is connected in series with the filament 60 and the capacitor 62 between the terminals 56 and 58 of the secondary winding 46. Such interacting capacitor/diode network when activated will change the expected magnitude of the voltage potential of the system as reflected by curve 32 shown in FIG. 4 and by measurement of the volt drop across capacitor 62, which is at least 100 VAC depending on its size. A pulsating DC current is fed by diode 64 to the filament 60 to maintain a nonfiring potential difference across filaments 60 and 54. Additionally, capacitor 62 discharges through filament 60 raising the potential on diode 64 and filament 60 during each current blocking phase of the capacitor charging cycle. A pulsating action is thereby achieved by the interaction of the diode 64 and the capacitor 62 because of the volt drop across filament 60 during the running operation under a steady state voltage restricted to lamp 12 to achieve a reduction in current drawn and decrease in temperature.

In the embodiment illustrated, the AC source voltage source has an operating voltage of 120 VAC to 347 VAC at a line frequency of approximately 50 to 60 Hz, while the regulating capacitor 62 has a capacitance value of approximately 2 to 7 microfarads, depending on the desired lumen output level of the lamps. The capacitor 62 is further more non-poled so that a low AC output at terminals 56 and 58 of approximately 3 to 4 VAC may charge the capacitor negative or positive dependent on phase determined by diode 64. When the capacitor charge reaches a sufficient level applying firing potential to filament 60, both capacitor 62 and 52 discharge after firing lamp 10. Capacitor 62 then recharges as a result of the plasma induced current flow between filaments in lamp 12. Such push-pull action of the current controller 28 independently of the starting capacitor 52 accounts for the output voltage modification aforementioned and the decrease in current and temperature conditions.

Figure 3:
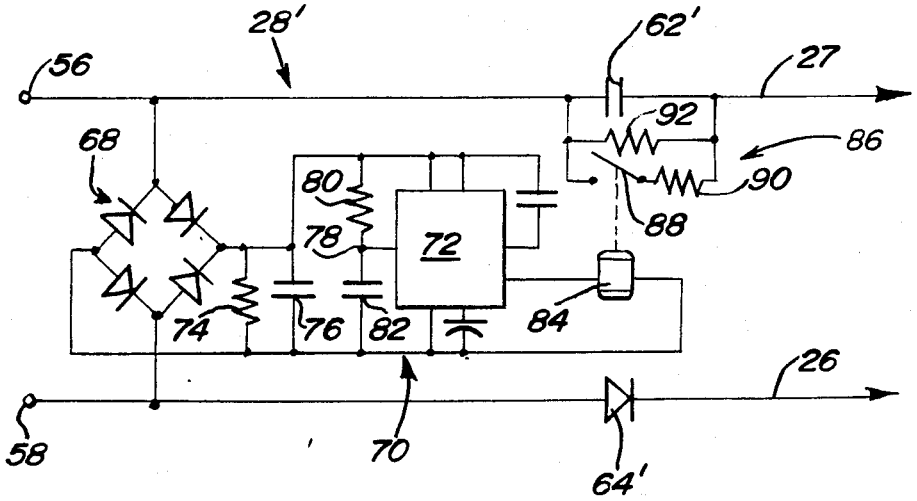
FIG. 3 is a circuit diagram illustrating a modified form of the current controller shown in FIG. 1, in accordance with another embodiment.

In order to avoid malfunction under low level power conditions experienced in some installations, a modified form of controller 28', as shown in FIG. 3 may be utilized as a replacement for the current controller 28 described with respect to FIG. 2. Current controller 28' includes a regulating capacitor 62' and diode 64' which are interconnected between the output terminals 56 and 58 of secondary winding 46 and the filament 60 to perform functions similar to those of capacitor 62 and diode 64 as herebefore described. A full wave voltage rectifier 68 is also connected across the winding terminals 56 and 58 to supply a rectified DC voltage for drive of a timing circuit 70. The output terminals of rectifier 68 are connected to the power terminals of an intergrated circuit chip 72 of the timing circuit, across which a filter network is formed by parallel connected resistor 74 and capacitor 76. The input terminal of chip 72 is connected to the junction 78 between the resistor 80 and capacitor 82 connected in series across the output terminals of rectifier 68. The output of timing circuit 70 is connected to a switch actuator 84 of a switching control circuit 86 having a bypass switch 88. The bypass switch 88 is connected in series with resistor 90 across the capacitor 62'. A discharge resistor 92 is also connected across the capacitor 62'. Upon closing of the power switch 41 to initiate start-up operation of the lamps, the timing circuit 70 is triggered into operation to close switch 88 thereby bypassing the capacitor 62' through resistor 90. Full available power is therefore applied to filament 60 for a timed period to allow the lamps to be properly fired under a conventional ignition cycle. At the end of such time delay, the switch 88 is opened by the timing circuit so that the current reducing action of the current controller 28' may be initiated with cyclic charge of the aiding capacitor 62' under the phase detecting and current blocking action of diode 64 as hereinbefore described with respect to FIG. 2.

The foregoing is considered illustrative only of the principles of the inventions. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. In an electrical system energized by an AC source, including at least two gaseous discharge lamps within which plasma induced current ignition occurs during a starting operation, two pairs of filaments respectively disposed within said lamps, a ballast transformer coupled to the AC source, a starting capacitor shunting one of the pairs of filaments within one of the lamps, means interconnecting one of the filaments in each of the lamps with each other for effecting said ignition of both of the lamps in response to a firing potential applied across said one of the pairs of filaments and means coupling the transformer to the filaments for applying said firing potential, the improvement comprising a regulating capacitor series connecting the transformer to another of the filaments within the other of the lamps independently of the starting capacitor and coupling means connected in interacting circuit relation to the regulating capacitor and said other of the filaments for restricting the firing potential to said one of the pairs of filaments during the starting operation.

2. The improvement as defined in claim 1 wherein said coupling means comprises a current blocking diode connected in series with the regulating capacitor and said other of the filaments.

3. The improvement as defined in claim 2 including timing means coupled to the transformer for delaying said restricting of the firing potential to said one of the pairs of filaments.

4. The improvement as defined in claim 1 including timing means coupled to the transformer for delaying said restricting of the firing potential to said one of the pairs of filaments.

5. In an electrical system energized by an AC source, including at least two gaseous discharge lamps within which plasma induced current ignition occurs during a starting operation, two pairs of filaments respectively disposed within said lamps, a ballast transformer coupled to the AC source, means interconnecting one of the filaments in each of the lamps with each other for effecting said ignition of both of the lamps in response to a firing potential applied across said one of the pairs of filaments, means coupling the transformer to the filaments for applying said firing potential and current controller means separately series connecting the transformer to another of the filaments of the other of the pairs of filaments, said current controller means restricting the firing potential to said one of the pairs of filaments during the starting operation.

6. The system as defined in claim 5 wherein said current controller means includes a non-poled capacitor, a current rectifying diode and interacting circuit means for connecting the capacitor and the diode in series with said other of the filaments to the transformer.

7. The system as defined in claim 6 including means for delaying said restricting of the firing potential to the one of the pairs of filaments by the current controller means.

8. The system as defined in claim 7 wherein said delaying means includes switch means connected in shunt relation to the capacitor for by-pass thereof and timing means driven by the transformer and actuating the switch means for limiting said by-pass of the capacitor to a predetermined delay interval.

9. The system as defined in claim 5 including switch means connected in shunt relation to the capacitor for by-pass thereof and timing means driven by the transformer and actuating the switch means for limiting said by-pass of the capacitor to a predetermined delay interval.

10. The system as defined in claim 5 wherein the ballast transformer includes a primary winding coupled to the AC source and a plurality of secondary windings connected by said coupling means to the filaments, one of the secondary windings being coupled to said other of the filaments by the current controller means and another of the secondary windings being coupled to the external filament interconnecting means.

11. The system as defined in claim 10 including a starting capacitor connected across said one of the pairs of filaments and to said other of the secondary windings.

* * * * *